United States Patent [19]

Yoshida et al.

[11] Patent Number: 4,884,430

[45] Date of Patent: Dec. 5, 1989

[54] FILAMENT DRAWING MACHINE

[75] Inventors: Kinzi Yoshida; Akira Yamamoto; Kazuo Iura, all of Izumi, Japan

[73] Assignee: Sumitomo Wiring Systems, Ltd., Japan

[21] Appl. No.: 164,805

[22] Filed: Mar. 7, 1988

[30] Foreign Application Priority Data

Apr. 24, 1987 [JP] Japan ..... 62-102356

[51] Int. Cl.[4] ..... B21C 3/12

[52] U.S. Cl. ..... 72/281

[58] Field of Search ..... 72/281, 282, 280, 278, 72/274, 468

[56] References Cited

U.S. PATENT DOCUMENTS

| | | | |
|---|---|---|---|
| 329,800 | 11/1885 | Allderdice | 72/281 |
| 946,631 | 1/1910 | Ballou | 72/281 |
| 1,529,713 | 3/1925 | Picotin | 72/281 |
| 1,578,351 | 3/1926 | Nullmeyer | 72/281 |
| 1,938,190 | 12/1933 | McIlvried et al. | 72/281 |
| 2,047,374 | 7/1936 | Larsen | 72/280 |
| 2,179,348 | 11/1939 | Penney | 72/280 |

FOREIGN PATENT DOCUMENTS

| | | | |
|---|---|---|---|
| 533437 | 10/1976 | U.S.S.R. | 72/468 |

*Primary Examiner*—Daniel C. Crane

*Attorney, Agent, or Firm*—Jordan B. Bierman

[57] ABSTRACT

A filament drawing device for drawing a plurality of strands simultaneously in a downstream direction through a plurality of groups of dies, there being one die for each strand. Each group of dies is held in a retaining mechanism including first and second portions which are adapted for movement toward and away from one another. When the retaining mechanism is in the open position, wherein the portions have been moved away from each other, any one of the plurality of dies may be removed without removing or displacing other dies in the same group. When the portions are moved toward each other, they overlie at least partially the dies in the group and thereby retain them in position.

40 Claims, 4 Drawing Sheets

FILAMENT DRAWING MACHINE

This Application claims the priority of Japanese 102356/1987, filed Apr. 24, 1987.

The present invention is directed to an improved wire drawing machine, particularly one intended for drawing a plurality of wires simultaneously. More specifically, it is directed to such a device which provides a simple means for replacing strands which break during drawing.

BACKGROUND OF THE INVENTION

Wire drawing devices of the general type disclosed herein have been known for many years. They comprise a plurality of capstans over which the wire being drawn passes. Normally, the wire loops at least once around each capstan and the dies are located between such capstans. Since a plurality of strands is drawn at the same time, the capstans are relatively long in the axial direction and often 7 or 8 such strands are wrapped around each one. There is a group of dies between capstans, each group containing a plurality of dies corresponding to the number of strands being drawn.

As is frequently the case, one or more strands breaks during the drawing operation. When a strand breaks, the operator must take the end of the strand and pass it through the opening of the corresponding die. He then must wind it around the next capstan and rotate the capstan by causing the machine to move slightly. He then must perform the same steps on the next die and capstan, and so on until he has completely rethreaded the broken strand. Then, the machine may be restarted and normal operation resumed.

If the broken strand happens to be other than the outermost one, the operator must work with his arms substantially extended. This creates a great strain on him and makes the job quite awkward. This is especially true when the wires are very fine and threading is difficult. Moreover, such fine wires might easily be broken by the movement of the operator's arms in the course of trying to thread a previously broken strand through the various dies and capstans.

SUMMARY OF THE INVENTION

It is an object of the present invention to provide a means whereby the operator of the machine may replace and rethread a broken strand, no matter where it is, easily without having to strain his arms and without danger of breaking other strands. In essence, the invention consists of providing means whereby the broken strand, and its corresponding die, may be easily moved to the front of the device for ready access by the operator.

In its broadest aspect, the present invention comprises a filament drawing device having a source of a plurality of strands to be drawn. There is at least one die group, there being one die in the group for each strand. Means for drawing the strands through the die group or groups is also provided.

Each group of dies is held in a retaining means which comprises first and second portions; these portions are capable of movement relative to one another between an open position and a closed position. When in the closed position, the portions at least partially overlie the die and retain them in position. When the portions are moved to their open position, sufficient space between them is provided so that one or more dies can be removed therethrough. Preferably, each portion has a recess therein into which a part of each of the dies fits.

Thus, when one of the plurality of strands breaks, the operator stops the machine. He then proceeds to the die group furthest upstream and moves the portions to their open position. The die corresponding to the broken strand is then removed through the opening formed, the remaining dies are slid in a direction transverse to the direction of movement of the strands away from the operator, and the removed die is placed in the outermost position which is nearest the operator. This movement carries the strand with it, so that it now becomes the outermost strand.

If necessary, the broken strand is then passed through the moved die, looped around the downstream capstan, and the same procedure repeated for each die group. Thereafter, the machine can be restarted.

Because the operator is working primarily on dies and strands which are closest to him, the opportunity for breaking other strands is minimized. Moreover, the strain of working with arms extended is eliminated.

DETAILED DESCRIPTION OF THE INVENTION

Figure 2:
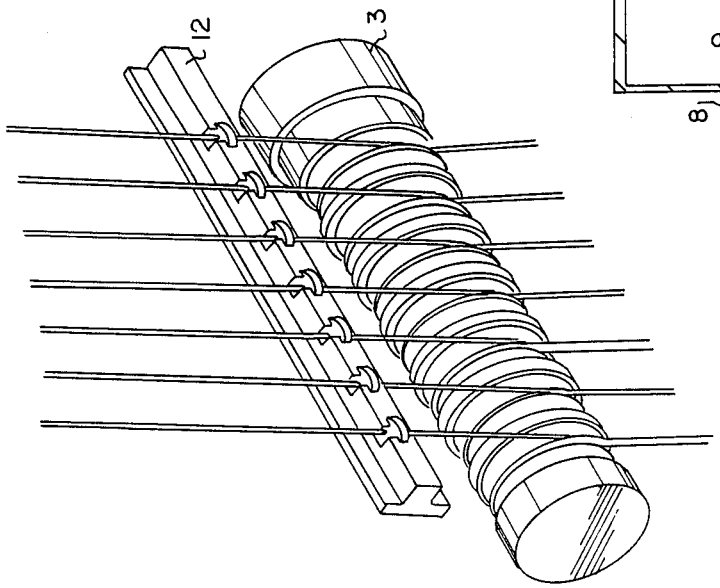
FIG. 2 PRIOR ART
FIG. 2 is an enlarged perspective view of a group of dies and a capstan in accordance with the prior art.
Figure 3:
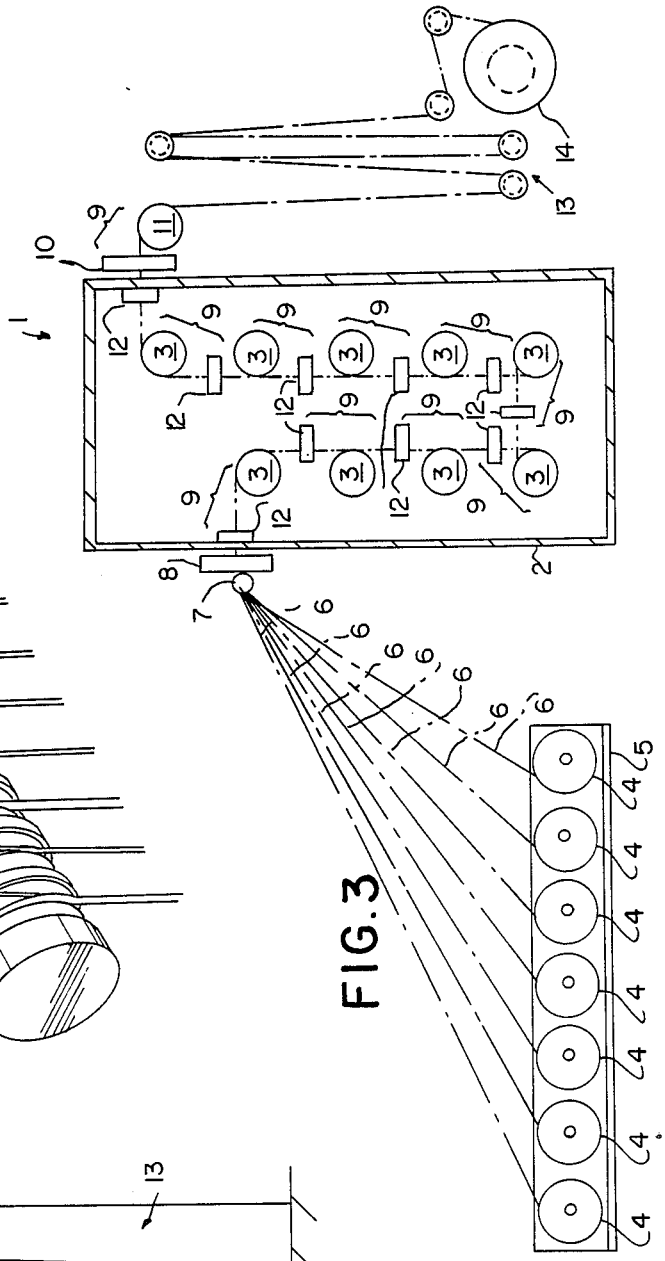
FIG. 3 a plan view, partly schematic, partly in section, of a device in accordance with the present invention.
Figure 1:
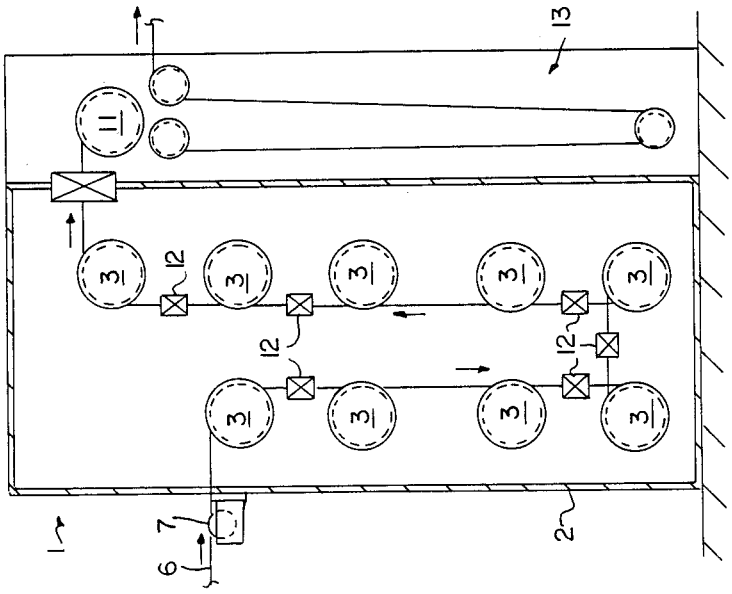
FIG. 1 PRIOR ART
FIG. 1 is a schematic view, partly in section, of a prior art device.
Figure 4:
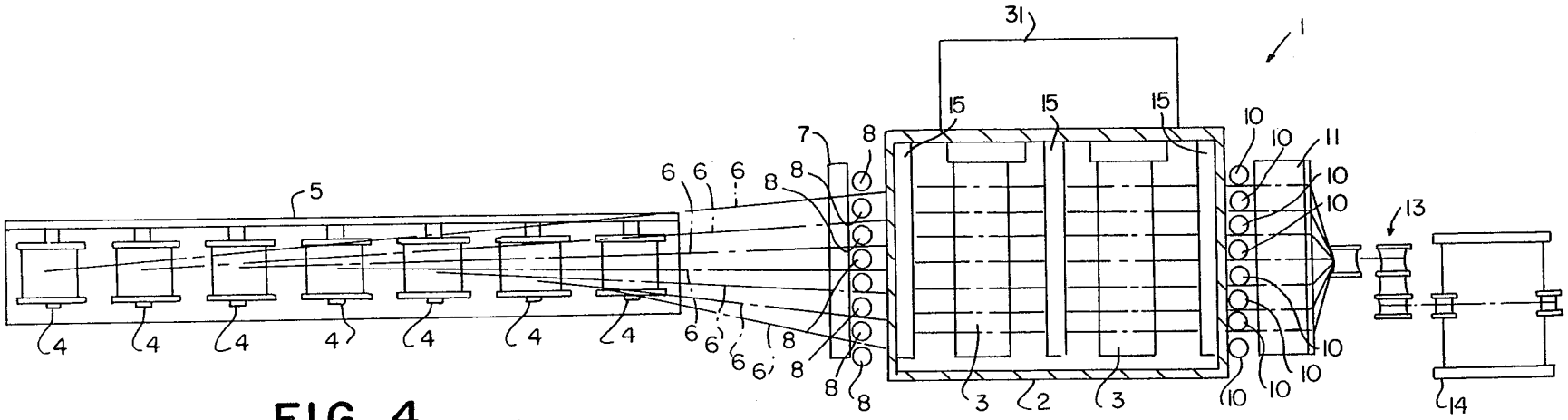
FIG. 4 is a view similar to that of FIG. 3, but in elevation.

The present invention will be described in terms of the drawing of wire. However, it will be appreciated that its scope is substantially broader than that and, in fact, will include the drawing of any ductile material. Referring particularly to FIGS. 3 and 4, device 1 of the present invention comprises supply reels 4, housing 2, capstans 3, and dies 12. Input guide roller 7 and input spacing rods 8 aid in distributing wires 6 over the surfaces of capstans 3. Exit spacing rods 10 and exit capstan 11 perform substantially the same function at the point at which the drawn wires leave housing 2. Exit capstan 11 may also function as a means for drawing wires 6. Tensioning means 13 and take-up reel 14 are provided for completion of the drawing operation. Drawing stages 9 are each comprised of capstan 3 and die 12. There is one die for each of wires 6.

Figure 6:
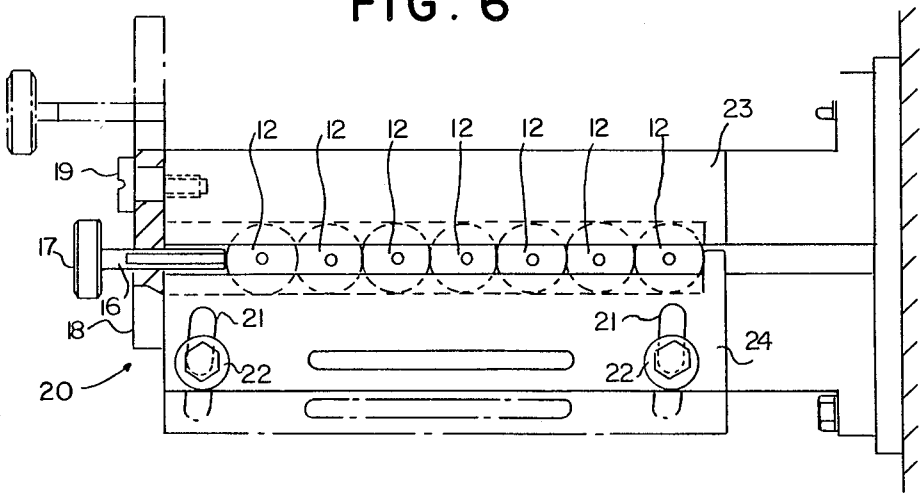
FIG. 6 is a sectional view along line 6—6 of FIG. 5.

In FIG. 6 a detail of die holder 20 for dies 12 is shown. There is one die 12 for each wire 6 arranged substantially in a line adjacent one another. They are held in place by stationary projection 29 on stationary portion 23 and movable projection 30 on movable portion 24. Movable portion 24 is positioned by securing nuts 22 in elongated slots 21.

Figure 8:
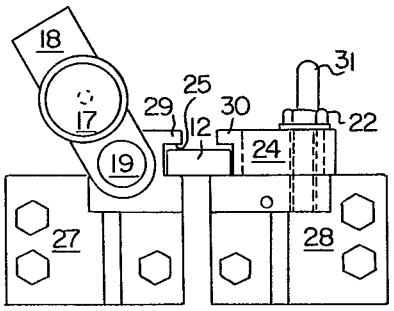
FIG. 8 is a view similar to FIG. 7 with the movable projection in closed position.
Figure 7:
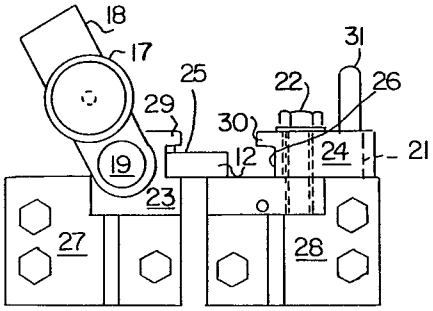
FIG. 7 is an end view of the device as shown in FIG. 6 with the movable projection in open position.
Figure 5:
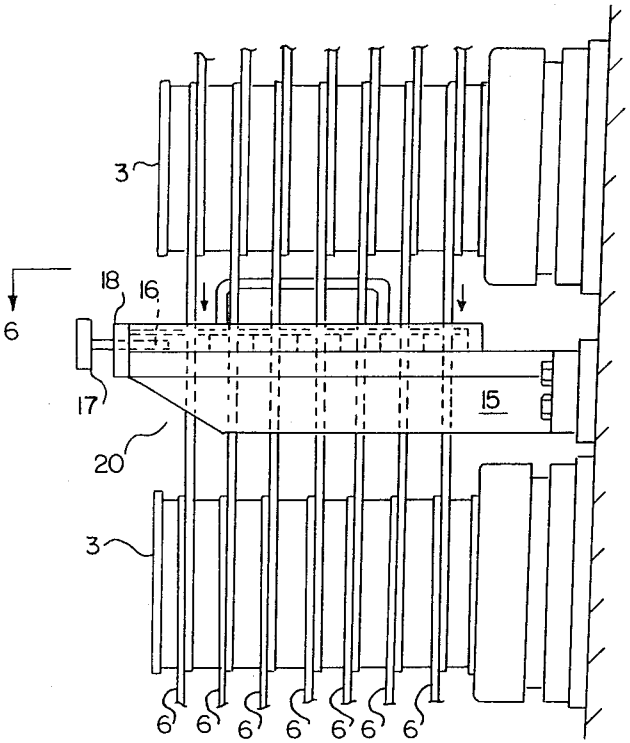
FIG. 5 is a partly schematic, partly sectional view of two capstans and an intermediate group of dies in accordance with the present invention.
Figure 9:
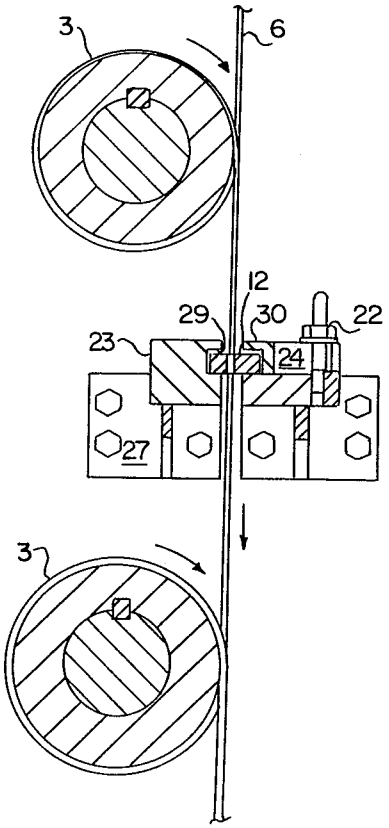
FIG. 9 is a sectional view along line 9—9 of FIG. 5.

As is shown in FIGS. 7 and 8, first holder member 27 carries stationary portion 23 and second holder member 28 carries movable portion 24. Locking plate 18 is mounted on stationary portion 23 at pivot 19. Locking screw 16 (see FIG. 5) is actuated by locking nut 17. In FIG. 7, movable portion 24 is shown in its open position, wherein any one of dies 12 may be removed from die holder 20. In FIG. 8, movable portion 24 is shown in its closed position, wherein dies 12 are retained against removal or inadvertent movement. Obviously, although the specific embodiment recites portion 23 as being stationary and portion 24 as being movable, the reverse could be true or both could be made movable. It is only necessary that there be provision for relative motion between portions 23 and 24 such that, when the portions are at their maximum distance apart, there is sufficient room to remove one or more dies 12.

In normal operation of device 1, wires 6 are drawn off supply reels 4 and pass over input guide roller 7. They pass through the passages formed by adjacent input spacing rods 8 through the first of dies 12 and are looped at least once around the first of capstans 3. Wires 6 then proceed serially through successive drawing stages 9 and exit housing 2 through the passages between adjacent exit spacing rods 10, pass over exit capstan 11, and are looped therearound at least once. Wires 6 then pass over tensioning means 13 and are wound onto take-up reel 14.

When one of wires 6 breaks, as commonly happens during the operation of device 1, the operator stops the machine and loosens locking nut 17 on the die holder 20 which is furthest upstream. Locking plate 18 is pivoted to the position shown in FIG. 8. Securing nuts 22 are loosened and movable portion 24 is slid away from stationary portion 23 to the position shown in FIG. 7. The one of dies 12 through which the broken strand passes is removed and the remaining dies slid to the right as shown in FIG. 6. Die 12 containing the broken wire is moved to the position at the extreme left of FIG. 6, a point which is convenient to the operator. Wire 6 passing therethrough is moved to the corresponding position on capstan 3, which is not difficult since the surfaces are preferably smooth. Movable portion 24 is then slid toward stationary portion 23 so that the position shown in FIG. 8 is achieved. Dies 12 are securely held in stationary groove 25 and movable groove 26. Locking plate 18 is then swiveled around pivot 19 to its closed position and locking nut 17 is tightened to securely hold dies 12 in place.

The foregoing procedure is repeated for each of stages 9. In those stages downstream of the actual break, the operator must also thread wire 6 through die 12 before replacement thereof otherwise, the steps are substantially the same as previously described.

In the embodiment of device 1 wherein input spacing rods 8 and/or exit spacing rods 10 are provided, when a break occurs, the operator must first move wires 6 so that the broken wire is in the passage between the outermost two rods. At the same time, the remaining wires 6 are moved inwardly to take up the passage vacated by the broken wire. A similar procedure is followed for the passages between exit spacing rods 10.

It can be seen from the foregoing that the present invention provides a method whereby the broken wire can be rethreaded at the points on device 1 which are closest and most convenient to the operator. This not only makes the task easier, but also minimizes the chances of breaking other wires while rethreading one which has already broken. Grooves 25 and 26 are, of course, preferred to the same length. This length is advantageously in accordance with the formula $$L=D(N+1)$$

wherein L is the length of grooves 25 and 26, N is the number of dies 12 (corresponding to the number of wires 6), and D is the diameter of one of dies 12.

The arrangement of supply reels 4 can be varied considerably, but it is advantageous to prevent contact between wires 6 after they are drawn from supply reels 4. One suitable arrangement is shown in FIGS. 3 and 4. Supply reels 4 are arranged on stand 5 spaced apart in a line which is perpendicular to their respective axes. This provides a series of angles at which wires 6 are drawn so that they do not contact one another at any point once they have left their respective supply reels. Similarly, in FIG. 4, it can be seen that the spacing as provided by rods 8 also serves to separate wires 6 from one another and aids in preventing contact.

We claim:

1. A filament drawing device comprising a source of a plurality of strands to be drawn in a downstream direction, at least one die group comprising a plurality of separate dies, each die having an opening for drawing said strands through the die opening along a path, there being one die in said group for each of said strands, means for drawing said strands through said die group, retaining means for each said group, each said retaining means comprising a first portion and a second portion adapted for movement relative to one another in a direction transverse to said path between an open position and a closed position, said retaining means, when in its open position, having its first and second portions spaced apart a greater distance than when said retaining means is in said closed position.

retaining means, when in said closed positions, at least partially overlying said die group whereby said die group is retained in said device, said first portion and said second portion, when said retaining means is in said open position, being spaced apart sufficiently to expose all said dies so that any die in said group may be recovered without removing any other die in said group, said first portion comprising a first recess which opposes a second recess in said second portion, said recesses extending in a transverse direction to said path and adapted to receive and retain said die group when said retaining means is in said closed position.

2. The device of claim 1 wherein said die in said die group is movable in a transverse direction to said downstream direction whereby, when one said die is removed, the remaining dies may be moved in said transverse direction so that they all abut one another.

3. The device of claim 2 wherein a releasable locking means is provided on at least one end of said die group, said locking means having a locked position and an unlocked position whereby when said locking means is in said locked position, movement of said dies in said group in said transverse direction is prevented and, when said locking means is in said unlocked position, movement of said dies in said group in said transverse direction is permitted.

4. The device of claim 3 wherein said locking means comprises a locking plate pivoted with respect to said one end of said die group whereby, when said locking means is in said locked position, said plate abuts said one end.

5. The device of claim 3 wherein there is provided a locking screw on said locking means, said screw adapted to bear against said die of said die group nearest said screw when said screw is tightened.

6. The device of claim 1 wherein a plurality of said die groups is provided and said means for drawing is adapted to draw said strands through said plurality of groups serially 7. The device of claim 1 wherein said means for drawing comprises a power driven capstan downstream of at least one said die group, said capstan adapted to receive a loop of each of said strands.

8. The device of claim 6 wherein said means for drawing comprises a power driven capstan downstream of each said die group, said capstan adapted to receive a loop of each of said strands.

9. The device of claim 1 wherein one of said first portion and said second portion is stationary.

10. The device of claim 7 wherein said capstan is provided with a surface which permits said strands to slide axially thereover.

11. The device of claim 1 wherein said strands are metallic wire.

12. The device of claim 1 wherein said source comprises a plurality of supply reels, each having said strands wound thereon.

13. The device of claim 1 wherein a plurality of rods is located upstream of said die group, said rods having axes substantially perpendicular to a plane substantially passing through said strands, said rods being spaced apart in a direction parallel to said plane to form passages therebetween, each of said passages adapted to have one of said strands pass therethrough.

14. The device of claim 12 wherein said supply reels are arranged so that said strands are drawn therefrom without touching one another once said strands have left said supply reels.

15. The device of claim 13 wherein said supply reels are arranged substantially in a line perpendicular to their axes.

16. The device of claim 15 wherein said line is substantially perpendicular to the direction in which said rods are spaced apart.

17. The device of claim 12 wherein each of said strands extends from one of said supply reels at an angle of elevation, said angle being different for each said strand whereby contact between said strands is avoided.

18. The device of claim 13 wherein said strands are substantially parallel to one another.

19. A method of replacing a broken strand in a device which comprises providing a source of a plurality of strands to be drawn in a downstream direction, at least one die group comprising a plurality of separate dies, each die having an opening for drawing said strands through the die openings along a path, there being one die in said group for each of said strands, means for drawing said strands through said die group, retaining means for each said group, each said retaining means comprising a first portion and a second portion adapted for movement relative to one another, between an open position and a closed position, said retaining means, when in its open position, having its first and second portion spaced apart a greater distance than when said retaining means is in said closed position, said retaining means, when in said closed position, at least partially overlying said die group whereby said die group is retained in said device, said first portion and said second portion, when said retaining means is in said open position, being spaced apart sufficiently to expose all said dies so that any said die in said group may be removed without removing any other die in said group, said first portion comprising a first recess which opposes a second recess in said second position, said recesses extending in a transverse direction to said path and adapted to receive and retain said die group when said retaining means is in said closed position, stopping said means for drawing, moving said retaining means retaining a first die group which is further upstream to said open position, removing a die having said broken strand, moving the remaining dies in said first die group in a transverse direction in said downstream direction away from an operator, passing said broken strand through said removed die, connecting said broken strand to said means for drawing, replacing said removed die in said first die group at a point nearest said operator, and repeating said method for each said die group.

20. The method of claim 19 wherein said replacing is effected by opening a locking means at an end of said first die group nearest said operator, inserting said removed die, and closing said locking means.

21. The method of claim 15 wherein, after closing said locking means, a locking screw is tightened to a point at which said screw bears against said removed die.

22. The method of claim 19 further comprising moving said broken strand to a passage between two adjacent rods which is nearest said operator, said rods having axes substantially perpendicular to a plane substantially passing through said strands.

23. A filament drawing device comprising a source of a plurality of strands to be drawn in a downstream direction, at least one die group comprising a plurality of dies, there being one die in said group for each of said strands, means for drawing said strands through said die group, retaining means for each said group, each said retaining means comprising a first portion and a second portion adapted for movement relative to one another between an open position and a closed position, said retaining means, when in its open position, having its first and second portions spaced apart a greater distance than when said retaining means is in said closed position, said retaining means, when in said closed position, at least partially overlying said die group whereby said die group is retained in said machine, said first portion and said second portion, when said retaining means is in said open position, being spaced apart sufficiently so that any said die in said group may be removed without removing any other die in said group, said die in said die group being movable in a transverse direction to said downstream direction whereby, when one said die is removed, the remaining dies may be moved in said transverse direction so that they all abut one another.

24. The device of claim 23 wherein said first portion comprises a first recess which opposes a second recess in said second portion, said recesses extending in said transverse direction to said downstream direction and adapted to receive and retain said die group when said retaining means is in said closed position.

25. The device of claim 23 wherein a releasable locking means is provided on at least one end of said die group, said locking means having a locked position and an unlocked position whereby when said locking means is in said locked position, movement of said dies in said group in said transverse direction is prevented and, when said locking means is in said unlocked position, movement of said dies in said group in said transverse direction is permitted.

26. The device of claim 25 wherein said locking means comprises a locking plate pivoted with respect to said one end of said die group whereby, when said locking means is in said locked position, said plate abuts said one end.

27. The device of claim 25 wherein there is provided a locking screw on said locking means, said screw adapted to bear against said die of said die group nearest said screw when said screw is tightened.

28. The device of claim 23 wherein a plurality of said die groups is provided and said means for drawing is adapted to draw said strands through said plurality of groups serially.

29. The device of claim 23 wherein said means for drawing comprises a power driven capstan downstream of at least one said die group, said capstan adapted to receive a loop of each of said strands.

30. The device of claim 28 wherein said means for drawing comprises a power driven capstan downstream of each of said die group, said capstan adapted to receive a loop of each of said strands.

31. The device of claim 23 wherein said one of said first portion and said second portion is stationary.

32. The device of claim 29 wherein said capstan is provided with a surface which permits said strands to slide axially thereover.

33. The device of claim 23 wherein said strands are metallic wire.

34. The device of claim 23 wherein said source comprises a plurality of supply reels, each having said strands wound thereon.

35. The device of claim 23 wherein said a plurality of rods is located upstream of said die group, said rods having axes substantially perpendicular to a plane substantially passing through said strands, said rods being spaced apart in a direction parallel to said plane to form passages therebetween, each of said passages adapted to have one of said strands pass therethrough.

36. The device of claim 34 wherein said supply reels are arranged so that said strands are drawn therefrom without touching one another once said strands have left said supply reels.

37. The device of claim 35 wherein said supply reels are arranged substantially in a line perpendicular to their axes.

38. The device of claim 27 wherein said line is substantially perpendicular to the direction in which said rods are spaced apart.

39. The device of claim 34 wherein each of said strands extends from one of said supply reels at an angle of elevation, said angle being different for each said strand whereby contact between said strands is avoided.

40. The device of claim 37 wherein said strands are substantially parallel to one another.

* * * * *